US009765454B2

(12) United States Patent
Tutterow et al.

(10) Patent No.: US 9,765,454 B2
(45) Date of Patent: Sep. 19, 2017

(54) FLAME RESISTANT FABRICS AND GARMENTS MADE FROM SAME

(71) Applicant: Southern Mills, Inc., Union City, GA (US)

(72) Inventors: D. Craig Tutterow, Rome, GA (US); Charles S. Dunn, Mableton, GA (US)

(73) Assignee: Southern Mills, Inc., Union City, GA (US)

( * ) Notice: Subject to any disclaimer, the term of this patent is extended or adjusted under 35 U.S.C. 154(b) by 0 days.

(21) Appl. No.: 14/561,409

(22) Filed: Dec. 5, 2014

(65) Prior Publication Data

US 2015/0086758 A1 Mar. 26, 2015

Related U.S. Application Data

(63) Continuation of application No. 12/688,203, filed on Jan. 15, 2010, now abandoned, which is a continuation of application No. 11/847,993, filed on Aug. 30, 2007, now abandoned.

(60) Provisional application No. 60/841,396, filed on Aug. 31, 2006.

(51) Int. Cl.

| | |
|---|---|
| ***D03D 15/12*** | (2006.01) |
| ***A41D 31/00*** | (2006.01) |
| ***D02G 3/44*** | (2006.01) |
| ***D04H 1/42*** | (2012.01) |
| ***D03D 9/00*** | (2006.01) |

(52) U.S. Cl.

CPC ..... *D02G 3/443* (2013.01); *A41D 31/0022* (2013.01); *D03D 9/00* (2013.01); *D03D 15/12* (2013.01); *D04H 1/42* (2013.01); *D10B 2201/20* (2013.01); *D10B 2321/101* (2013.01); *D10B 2331/021* (2013.01); *Y10T 428/2481* (2015.01); *Y10T 428/249921* (2015.04); *Y10T 442/10* (2015.04); *Y10T 442/30* (2015.04); *Y10T 442/3984* (2015.04); *Y10T 442/40* (2015.04); *Y10T 442/696* (2015.04)

(58) Field of Classification Search

CPC ..... A41D 31/0022; D02G 3/443; D03D 15/12
USPC ..... 442/197, 301, 302, 310; 428/920, 921
See application file for complete search history.

(56) References Cited

U.S. PATENT DOCUMENTS

| | | | | |
|---|---|---|---|---|
| 3,729,920 | A | 5/1973 | Sayers et al. | |
| 3,763,644 | A | 10/1973 | Jackson, Jr. et al. | |
| 4,533,592 | A | 8/1985 | Bingham | |
| 4,710,200 | A * | 12/1987 | Cates | D06P 1/926 8/130.1 |
| 4,981,488 | A | 1/1991 | Cates et al. | |
| 4,996,099 | A | 2/1991 | Cooke et al. | |
| 5,150,476 | A | 9/1992 | Statham et al. | |
| 5,208,105 | A | 5/1993 | Ichibori et al. | |
| 5,275,627 | A | 1/1994 | Cates et al. | |
| 5,694,981 | A | 12/1997 | Stanhope et al. | |
| 5,824,614 | A | 10/1998 | Gadoury et al. | |
| 5,830,574 | A | 11/1998 | Gadoury | |
| 5,849,648 | A | 12/1998 | Kent et al. | |
| 5,885,307 | A | 3/1999 | Gadoury | |
| 5,891,813 | A | 4/1999 | Gadoury | |
| 6,132,476 | A | 10/2000 | Lunsford et al. | |
| 6,146,759 | A | 11/2000 | Land | |
| 6,192,520 | B1 | 2/2001 | Underwood et al. | |
| 6,410,140 | B1 | 6/2002 | Land et al. | |
| 6,451,070 | B1 | 9/2002 | Kent et al. | |
| 6,534,175 | B1 | 3/2003 | Zhu et al. | |

(Continued)

FOREIGN PATENT DOCUMENTS

| | | |
|---|---|---|
| AU | 2007290499 B2 | 7/2012 |
| BE | 1015931 | 11/2005 |

(Continued)

OTHER PUBLICATIONS

International Search Report and Written Opinion, PCT Patent Application No. PCT/US2007/019046, mailed Jan. 18, 2008.
Smith, "Lyocell—One Fiber, Many Faces", Ohio State University, Aug. 30, 2006, http://ohioline.osu.edu/hyg-fact/5000/5572.html.
Office Action, Australian Patent Application No. 2007290499, mailed Mar. 6, 2012.
Response to Office Action, Australian Patent Application No. 2007290499, filed May 25, 2012.
Office Action, Australian Patent Application No. 2012208990, mailed May 2, 2013.
Response to Office Action, Australian Patent Application No. 2012208990, filed Oct. 17, 2014.
Office Action, Canadian Patent Application No. 2,661,843, mailed Nov. 17, 2013.

(Continued)

*Primary Examiner* — Jenna Johnson
(74) *Attorney, Agent, or Firm* — Kilpatrick Townsend & Stockton LLP

(57) ABSTRACT

Unique blends of fibers that incorporate synthetic cellulosic fibers to render fabrics made with such blends more durable than fabrics made with natural cellulosic fibers such as cotton. While more durable than cotton, the synthetic cellulosic fibers used in the blends are still inexpensive and comfortable to the wearer. Thus, the benefits of cotton (affordability and comfort) are still attained while a drawback of cotton—low durability—is avoided. In one embodiment, the fiber blend includes FR modacrylic fibers and synthetic cellulosic fibers, preferably, but not necessarily non-FR lyocell fibers such as TENCEL™ and TENCEL A100™. Other fibers may be added to the blend, including, but not limited to, additional types of inherently FR fibers, anti-static fibers, anti-microbial fibers, stretch fibers, and/or high tenacity fibers. The fiber blends disclosed herein may be used to form various types of FR fabrics. Desired colors may be imparted in a variety of ways and with a variety of dyes to the fabrics disclosed herein. Fabrics having the fibers blends disclosed herein can be used to construct the entirety of, or various portions of, a variety of protective garments for protecting the wearer against electrical arc flash and flames, including, but not limited to, coveralls, jumpsuits, shirts, jackets, vests, and trousers.

17 Claims, No Drawings

(56) References Cited

U.S. PATENT DOCUMENTS

| | | | | |
|---|---|---|---|---|
| 6,547,835 | B1 | 4/2003 | Lunsford et al. | |
| 6,626,964 | B1 | 9/2003 | Lunsford et al. | |
| 6,706,650 | B2 | 3/2004 | Gibson et al. | |
| 6,735,789 | B2 | 5/2004 | Kelleher et al. | |
| 6,787,228 | B2 | 9/2004 | Campbell et al. | |
| 6,946,412 | B2 | 9/2005 | Campbell et al. | |
| 7,065,950 | B2 | 6/2006 | Zhu et al. | |
| 7,156,883 | B2 | 1/2007 | Lovasic et al. | |
| 2001/0009832 | A1 | 7/2001 | Shaffer et al. | |
| 2002/0064654 | A1 | 5/2002 | Luo et al. | |
| 2002/0182967 | A1 | 12/2002 | Erb, Jr. et al. | |
| 2003/0226612 | A1 | 12/2003 | Zhu et al. | |
| 2003/0228812 | A1 | 12/2003 | Stanhope et al. | |
| 2003/0228821 | A1 | 12/2003 | Zhu et al. | |
| 2003/0232560 | A1 | 12/2003 | Corner | |
| 2004/0065072 | A1 | 4/2004 | Zhu et al. | |
| 2004/0152378 | A1 | 8/2004 | Stanhope et al. | |
| 2004/0192134 | A1 | 9/2004 | Gibson et al. | |
| 2005/0032449 | A1 | 2/2005 | Lovasic et al. | |
| 2005/0197028 | A1* | 9/2005 | Hartgrove | D04H 1/465 442/408 |
| 2005/0208855 | A1* | 9/2005 | Zhu | D02G 3/047 442/302 |
| 2005/0287364 | A1 | 12/2005 | Zhu et al. | |
| 2006/0030228 | A1 | 2/2006 | Truesdale, III | |
| 2006/0040575 | A1 | 2/2006 | Kelleher et al. | |
| 2006/0068664 | A1 | 3/2006 | Gibson et al. | |
| 2006/0084337 | A1 | 4/2006 | Corner et al. | |
| 2006/0116043 | A1* | 6/2006 | Hope | D02G 3/04 442/301 |
| 2006/0292953 | A1* | 12/2006 | Ashley | A41D 31/0022 442/197 |
| 2007/0178788 | A1 | 8/2007 | Link et al. | |
| 2007/0184737 | A1 | 8/2007 | Corner et al. | |
| 2007/0248765 | A1 | 10/2007 | Truesdale, III et al. | |
| 2007/0249247 | A1 | 10/2007 | Truesdale, III et al. | |
| 2008/0057807 | A1 | 3/2008 | Tutterow et al. | |
| 2010/0112312 | A1 | 5/2010 | Tutterow et al. | |

FOREIGN PATENT DOCUMENTS

| | | | |
|---|---|---|---|
| EP | 1247885 | | 10/2002 |
| EP | 1754813 | | 2/2007 |
| EP | 1767677 | A1 | 3/2007 |
| GB | 1126432 | | 9/1968 |
| JP | 08158201 | | 6/1996 |
| JP | H08-209486 | A | 8/1996 |
| WO | 2004088023 | | 10/2004 |
| WO | 2005092132 | A1 | 10/2005 |
| WO | 2006008900 | A1 | 1/2006 |
| WO | 2006017709 | | 2/2006 |
| WO | 2006034131 | | 3/2006 |
| WO | 2006043958 | | 4/2006 |
| WO | 2006049626 | | 5/2006 |
| WO | 2006101933 | A2 | 9/2006 |
| WO | 2007070079 | | 6/2007 |
| WO | 2007133177 | | 11/2007 |
| WO | 2008048308 | | 4/2008 |

OTHER PUBLICATIONS

Response to Office Action, Canadian Patent Application No. 2,661,843, filed Mar. 31, 2014.
Office Action, Canadian Patent Application No. 2,661,843, mailed Jul. 8, 2014.
Response to Office Action, Canadian Patent Application No. 2,661,843, filed Oct. 30, 2014.
Office Action, European Patent Application No. 07811603.5, mailed Nov. 3, 2009.
Response to Office Action, European Patent Application No. 07811603.5, filed Aug. 26, 2012.
Response to Office Action, European Patent Application No. 07811603.5, mailed Mar. 27, 2012.
Office Action, European Patent Application No. 07811603.5, mailed Oct. 5, 2012.
Response to Office Action, European Patent Application No. 07811603.5, filed Dec. 12, 2012.
Office Action, Japanese Patent Application No. 2009-526707, mailed Oct. 2, 2012.
Office Action, Japanese Patent Application No. 2009-526707, mailed Oct. 22, 2013.
Office Action, Japanese Patent Application No. 2009-526707, mailed May 20, 2014.
Office Action, Canadian Patent Application No. 2,661,843, mailed Dec. 15, 2014.
Notice of Acceptance, Australian Patent Application No. 2012208990, mailed Nov. 19, 2014.
Notice of Allowance, Canadian Patent Application No. 2,661,843, mailed Aug. 19, 2015.
Office Action, Japanese Patent Application No. 2009-526707, mailed Jul. 14, 2015.
Decision of Grant, Japanese Patent Application No. 2009-526707, mailed Mar. 8, 2016.
Examination Report, Australian Patent Application No. 2015201105, mailed Mar. 16, 2016.
Office Action, Japanese Patent Application No. 2014-191305, mailed Sep. 29, 2015.

* cited by examiner

FLAME RESISTANT FABRICS AND GARMENTS MADE FROM SAME

RELATED APPLICATION

This is a continuation application of U.S. patent application Ser. No. 12/688,203, filed Jan. 15, 2010, which is a continuation application of U.S. patent application Ser. No. 11/847,993, filed Aug. 30, 2007, which claims the benefit of U.S. Provisional Patent Application No. 60/841,396, filed Aug. 31, 2006, the entire contents of which are incorporated herein by reference.

FIELD OF THE INVENTION

The present invention relates to protective fabrics, and more specifically to flame resistant fabrics, having a unique blend of fibers and garments made from such fabrics.

BACKGROUND OF THE INVENTION

Many occupations can potentially expose an individual to electrical arc flash and/or flames. To avoid being injured while working in such conditions, these individuals typically wear protective garments constructed of flame resistant materials designed to protect them from electrical arc flash and/or flames. Such protective clothing can include various garments, for example, coveralls, pants, and shirts. Fabrics from which such garments are constructed, and consequently the resulting garments as well, are required to pass a variety of safety and/or performance standards, including ASTM F 1506, NFPA 2112, NFPA 70E, MIL C 43829C.

Many protective garments have been made from fabrics comprising natural cellulosic fibers, such as cotton. Cotton fibers are inexpensive and fabrics made from such fibers comfortable to wear. However, the use of cotton fibers in such fabrics has many disadvantages. To begin, cotton fibers are not durable. Thus, fabrics made with them have poor wear life and must be replaced unacceptably often.

Furthermore, cotton fibers pose a health hazard to personnel during the fiber spinning and fabric weaving processes. When natural cotton fibers are used to make fabrics and garments, the cotton fibers can be inhaled and over time can cause respiratory problems, which can lead to byssinosis or "brown lung" disease. Work environments where personnel work with natural cotton and are exposed to breathing hazardous cotton fibers are thus subject to governmental and regulatory restrictions for handling and processing of such fibers.

Moreover, cotton fibers are not inherently flame resistant and thus apt to burn. Thus, these fibers (or the yarns or fabrics made with such fibers) have historically been treated with a FR compound to render such fibers (or the yarns or fabrics made with such fibers) flame resistant. Treatment of cotton fibers (or the yarns or fabrics made with such fibers) with an FR compound significantly increases the cost of such fibers (or the yarns or fabrics made with such fibers).

To avoid the cost associated with such FR treatment, cotton fibers have been combined with FR modacrylic fibers. The FR modacrylic fibers control and counteract the flammability of the cotton fibers to prevent the cotton fibers from burning. In this way, the cotton fibers (or the yarns or fabrics made with such fibers) need not be treated with a FR compound.

However, the FR modacrylic fibers have durability problems similar to those of cotton, and thus fabrics made with blends of these fibers have poor wear life. Moreover, both natural cotton fibers and FR modacrylic fibers are relatively unstable after thermal exposure, rendering it difficult if not impossible for fabrics made with only these fibers to pass the requisite safety and performance standards for protective garments. Thus, additional inherently FR fibers, such as aramid fibers, have been added to the fiber blend to impart thermal stability to the blend to ensure compliance of the resulting fabric with the requisite safety and performance standards (e.g., by decreasing char lengths in vertical flame tests of such fabrics).

Because of the presence of cotton fibers, the resulting fabrics still exhibit durability problems and unacceptable wear life. Thus, a need exists for fiber blends that include fibers that are more durable than natural cellulosic fibers such as cotton but that still realize the cost and comfort advantages of cotton in such blends.

SUMMARY OF THE INVENTION

This invention discloses unique blends of fibers that incorporate synthetic cellulosic fibers to render fabrics made with such blends more durable than fabrics made with natural cellulosic fibers such as cotton. While more durable than cotton, the synthetic cellulosic fibers used in the blends are still inexpensive and comfortable to the wearer. Thus, the benefits of cotton (affordability and comfort) are still attained while a drawback of cotton—low durability—is avoided. The resulting fabrics made with the fiber blends disclosed herein are flame resistant, durable, comfortable, and affordable.

In one embodiment, the fiber blend includes FR modacrylic fibers and synthetic cellulosic fibers, preferably, but not necessarily non-FR lyocell fibers such as TENCEL™ and TENCEL A100™. The FR modacrylic fibers and the synthetic cellulosic fibers can be combined in any blend ratio but are preferably, although not necessarily, combined so that the percentage of FR modacrylic fibers in the blend is greater than the percentage of synthetic cellulosic fibers in the blend. Other fibers may be added to the blend, including, but not limited to, additional types of inherently FR fibers, anti-static fibers, anti-microbial fibers, stretch fibers, and/or high tenacity fibers.

The fiber blends disclosed herein may be used to form various types of FR fabrics. By way only of example, the fibers may be used to form nonwoven fabrics or may first be formed into yarn that is subsequently woven or knitted into a FR fabric.

In one embodiment, yarns are formed from a fiber blend having approximately 30-60% FR modacrylic fibers, approximately 20-60% synthetic cellulosic fibers, and approximately 5-30% additional inherently FR fibers. TENCEL™ and particularly TENCEL A100™ (both non-FR synthetic cellulosic fibers) and para-aramid fibers (inherently FR fibers) have performed particularly well in this application. The yarns can subsequently be used to form FR fabrics in a variety of ways (e.g. weaving, knitting, etc.), all well known in the industry. Fabrics made from the unique fiber blends disclosed herein comply with a variety of the thermal protection standards, rendering them suitable for use in protective garments.

Desired colors may be imparted in a variety of ways and with a variety of dyes to the fabrics disclosed herein having a blend of synthetic cellulosic, FR modacrylic, and optionally additional inherently FR fibers. The fabrics may be dyed or printed to comply with the standard for high-visibility safety apparel known in the industry as ANSI 107-2004 (and the European equivalent EN 471) as well as with the military's infrared reflective requirements (including, but not limited to, those promulgated under MIL-C-83429 and GL-PD-07-12 (Feb. 28, 2007)).

Fabrics having the fibers blends disclosed herein can be used to construct the entirety of, or various portions of, a variety of protective garments for protecting the wearer against electrical arc flash and flames, including, but not limited to, coveralls, jumpsuits, shirts, jackets, vests, and trousers. In one embodiment, a fabric having blends of fibers disclosed herein is used to form at least a portion of an advanced combat shirt.

DETAILED DESCRIPTION OF THE INVENTION

This invention relates to unique blends of fibers that render the resulting fabric flame resistant, durable, comfortable, and affordable. In one embodiment, the fiber blend includes FR modacrylic fibers and manmade or synthetic cellulosic fibers. The FR modacrylic fibers and the synthetic cellulosic fibers can be combined in any blend ratio but are preferably, although not necessarily, combined so that the percentage of FR modacrylic fibers in the blend is greater than the percentage of synthetic cellulosic fibers in the blend.

Any FR modacrylic fibers able to extinguish non-FR fibers may be used, including, but not limited to, PROTEX™ fibers (including but not limited to PROTEX W™ and PROTEX C™ fibers) available from Kaneka Corporation of Osaka, Japan, SEF™ available from Solutia, or blends thereof. The synthetic cellulosic fibers may be, but are not limited to, rayon, FR rayon, lyocell, MODAL™, cellulose acetate, or blends thereof. An example of a suitable rayon fiber is Viscose by Lenzing, available from Lenzing Fibers Corporation. Examples of lyocell fibers include TENCEL™ and TENCEL A100™, both available from Lenzing Fibers Corporation. Examples of FR rayon fibers include Lenzing FR™, also available from Lenzing Fibers Corporation, and VISIL™, available from Sateri.

The synthetic fibers used in the blends disclosed herein can be, but preferably are not, FR-treated given that they are being blended with FR modacrylic fibers that control and counteract the flammability of the synthetic fibers to prevent such fibers from burning Use of synthetic cellulosic fibers that have not been FR-treated significantly reduces the cost of such fibers (e.g., approximately $1/pound for non-FR treated synthetic cellulosic fibers vs. approximately $6/pound for FR-treated synthetic cellulosic fibers).

Non-FR lyocell fibers such as TENCEL™ and TENCEL A100™ fibers have proven to be particularly suitable in this application. While similar to cotton fibers in that these fibers are inexpensive and comfortable, they are more durable than natural cotton fibers and have proven very resistant to abrasion and very moisture absorbent. Consequently, fabrics made from these fibers have long wear life and are comfortable to the wearer. TENCEL A100™ fibers are less susceptible to fibrillation, which results when the ends of the fibers split to impart a fuzzy or prematurely worn appearance to garments made with such fibers. It has been found that fabrics made with TENCEL A100™ fibers are thus better able to retain their appearance even after repeated launderings. Moreover, unlike natural cotton typically used in these blends, because these cellulosic fibers are manmade fibers, they consequently do not pose a breathing hazard to personnel during the fiber spinning or fabric fabrication process.

In an alternative embodiment, an additional type (or types) of inherently FR fibers (i.e., in addition to the FR modacrylic fibers which are inherently FR) may be added to the FR modacrylic/synthetic cellulosic fiber blend. The additional inherently FR fibers may include, but do not have to include, para-aramid fibers, meta-aramid fibers, polybenzimidazole (PBI) fibers, polybenzoxazole (PBO) fibers, melamine fibers, carbon fibers, pre-oxidized acrylic fibers, polyacrylonitrile (PAN) fibers, TANLON™ (available from Shanghai Tanlon Fiber Company), polyamide-imide fibers such as KERMEL™, and blends thereof. Examples of para-aramid fibers include KEVLAR™ (available from DuPont), TECHNORA™ (available from Teijin Twaron BV of Arnheim, Netherlands), and TWARON™ (also available from Teijin Twaron BV). Examples of meta-aramid fibers include NOMEX™ (available from DuPont), CONEX™ (available from Teijin), and APYEIL™ (available from Unitika). An example of melamine fibers is BASOFIL™ (available from Basofil Fibers). An example of PAN fibers is Panox® (available from the SGL Group). As explained above, such inherently FR fibers impart the requisite thermal stability to the blend to enable fabrics made from such blends to be used in protective garments.

In other embodiments, additional fibers, including, but not limited to (1) anti-static fibers to dissipate or minimize static, (2) anti-microbial fibers, (3) stretch fibers (e.g., spandex), and/or (4) high tenacity fibers such as, but not limited to, nylon and/or polyester fibers (such as VECTRAN™) are added to the blends to improve the wear property of fabrics made with such blends.

The fiber blends disclosed herein may be used to form various types of FR fabrics. By way only of example, the fibers may be used to form nonwoven fabrics or may first be formed into yarn that is subsequently woven or knitted into a FR fabric.

In one embodiment, yarns are formed from a fiber blend having approximately 30-60% FR modacrylic fibers, approximately 20-60% synthetic cellulosic fibers, and approximately 5-30% additional inherently FR fibers. TENCEL™ and particularly TENCEL A100™ (both non-FR synthetic cellulosic fibers) and para-aramid fibers (inherently FR fibers) have performed particularly well in this application. The same types of FR modacrylic fibers, synthetic cellulosic fibers, and additional inherently FR fibers need not be used in the blend. Rather, multiple types of each may be blended together.

The yarns can be formed in conventional ways well known in the industry. The yarns may be spun yarns and can comprise a single yarn or two or more individual yarns that are twisted, or otherwise combined, together. In one embodiment, the yarns are air jet spun yarns. Typically, the yarns comprise one or more yarns that each have a yarn count in the range of approximately 5 to 60 cc. In one embodiment, the yarns comprise two yarns that are twisted together, each having a yarn count in the range of approximately 10 to 60 cc.

The yarns can subsequently be used to form FR fabrics in a variety of ways, all well known in the industry. The yarns can be knitted or woven. In one embodiment, the FR fabric is formed as a plain weave fabric that comprises a plurality of body yarns. However, it will be appreciated that other configurations could be used including, for instance, a rip-stop or a twill weave such as a 2×1 right hand twill weave.

Regardless of the manner by which the FR fabric is formed (nonwoven, knitted, woven, etc.), the FR fabric can be made from a blend of fibers that includes having approximately 30-60% FR modacrylic fibers, approximately 20-60% synthetic cellulosic fibers (preferably, but not necessarily, TENCEL™ fibers and more preferably TENCEL A100™ fibers) and approximately 5-30% additional inherently FR fibers (preferably, but not necessarily, para-aramid fibers). As discussed above, the FR fabric may include a fiber blend that includes anti-static, anti-microbial, stretch, and/or high tenacity fibers.

In a much more specific example that is certainly not intended to limit the scope of the invention discussed herein, the FR fabric includes a blend of between approximately 40-50% FR modacrylic fibers, approximately 30-40% synthetic cellulosic fibers (preferably, but not necessarily, TENCEL™ fibers and more preferably TENCEL A100™ fibers), and approximately 10-15% aramid fibers (preferably, but not necessarily, para-aramid fibers).

The FR fabrics formed with the blends disclosed herein preferably, but not necessarily, have a weight between approximately 3-12 ounces per square yard ("osy") and more preferably between approximately 5-9 osy.

Specific examples of embodiments of fabrics in accordance with the invention are described as follows.

Fabric Blend #1: One embodiment of the invention is a fabric with a blend of approximately 50% PROTEX W™ (FR modacrylic), approximately 40% TENCEL A100™ (cellulosic), and approximately 10% TWARON™ (para-aramid).

Fabric Blend #2: Another embodiment of the invention is a fabric with a blend of approximately 45% PROTEX W™ (FR modacrylic), approximately 35% TENCEL A100™ (cellulosic), approximately 10% Lenzing FR™ or FR rayon (cellulosic), and 10% TWARON™ (para-aramid).

Fabric Blend #3: Another embodiment of the invention is a fabric with a blend of approximately 50% PROTEX W™ (FR modacrylic), approximately 35% TENCEL A100™ (cellulosic), approximately 10% nylon, and approximately 5% TWARON™ (para-aramid).

Fabric Blend #4: Another embodiment of the invention is a fabric with a blend of approximately 48% PROTEX W™ (FR modacrylic), approximately 37% TENCEL A100™ (cellulosic), and approximately 15% TWARON™ (para-aramid).

As evidenced in Table 1, FR fabrics made from the unique fiber blends disclosed herein comply with the before-wash vertical flammability requirements set forth in ASTM F 1506 and NFPA 70E, including having acceptable arc thermal protective values ("ATPV"). Workers who may be exposed to accidental electric arc flash risk serious burn injury unless they are properly protected. NFPA 70E is the standard that addresses electrical safety requirements, providing information on all aspects of electrical safety in the workplace. NFPA 70E offers a method to match protective clothing to potential exposure levels incorporating Hazard Risk Categories (HRC). Protective fabrics are tested to determine their ATPV or arc rating in cal/cm$^2$ (calories per square centimeter). The ATPV is determined by ASTM test method F 1959, where sensors measure thermal energy properties of protective fabric specimens during exposure to a series of electric arcs. The measured arc rating determines the HRC for a fabric as follows:

Hazard Risk Category and ATPV

HRC 1: ATPV: 4 cal/cm$^2$

HRC 2: ATPV: 8 cal/cm$^2$

HRC 3: ATPV: 25 cal/cm$^2$

HRC 4: ATPV: 40 cal/cm$^2$

In addition to complying with ASTM F 1506 and NFPA 70E as discussed above, Fabric Blends #2-#4 comply with the before-wash vertical flammability requirements set forth in ASTM 2112, including having acceptable char lengths (as measured with the testing method set forth in ASTM 6413).

TABLE 1

| Fabric Blend | Fabric Weight (ounces per square yard or "osy") | Char length (inches) warp × fill | ATPV (cal/cm$^2$) | Ratio of ATPV to Weight |
|---|---|---|---|---|
| Fabric Blend #1 | 9.3 | 4.2 × 3.5 | 8.8 | 0.95 |
| Fabric Blend #2 | 8.4 | 3.1 × 2.8 | 8.2 | 0.97 |
| Fabric Blend #3 | 8.6 | 3.3 × 2.3 | 6.8 | 0.79 |
| Fabric Blend #4 | 8.4 | 3.3 × 2.6 | 9.3 | 1.10 |
| Fabric Blend #4 | 7.6 | 3.5 × 2.7 | 8.4 | 1.11 |

Fabrics made from the fiber blends contemplated in this application also have surprisingly high resistances to abrasion. As explained above, TENCEL™ and TENCEL A100™ fibers are very durable fibers. It is not surprising, therefore, that Taber abrasion test results of fabrics made from fiber blends having such fibers indicate substantially high resistance to abrasion—indeed almost as high as fabrics made from 100% inherently FR fibers and higher than fabrics made with other fiber blends that comply with the ASTM F 1506, NFPA 2112, and NFPA 70E standards. Moreover, while abrasion resistance is high, the inclusion of modacrylic and cellulosic fibers in the blends contemplated herein render the resulting fabric soft and thus more comfortable to the wearer.

Desired colors may be imparted in a variety of ways to the fabrics disclosed herein having a blend of synthetic cellulosic, FR modacrylic, and optionally additional inherently FR fibers. In one embodiment, the synthetic cellulosic fibers and/or modacrylic fibers are dyed (either prior to their formation into yarn, after formation into yarns, or in the final fabric). The synthetic cellulosic and/or modacrylic fibers may be dyed any of a variety of colors, including, but not limited to, yellow, fluorescent yellow, green, orange, red, blue, gray, etc. using the dyes (or combinations of dyes) disclosed herein.

Dyeing may be achieved using a variety of well-known techniques, including exhaust dyeing processes using a jet, beam, beck, or jig dyeing apparatus or continuous dyeing processes, all of which are well known in the art. Suitable dyes for dyeing the modacrylic fibers include, but are not limited to, basic dyes and disperse dyes. Suitable dyes for dyeing the synthetic cellulosic fibers include, but are not limited to, fiber reactive dyes, direct dyes, and vat dyes.

In one embodiment, the fabrics are dyed to comply with the standard for high-visibility safety apparel known in the industry as ANSI 107-2004 and the European equivalent EN 471. To comply with ANSI 107-2004, a fabric must (1) be dyed to a high-visibility shade (measured by reference to a fabric's chromaticity and luminance) and (2) maintain that high-visibility shade after being subjected to light for a specified period of time (an attribute referred to in the standard as "light fastness"). The dyes for each of the synthetic cellulosic fibers and the modacrylic fibers are thus selected so as to achieve dyeing of these fibers to a high-visibility shade. Dyes that enable dyeing of the synthetic cellulosic fibers to a high-visibility shade include, but are not limited to, direct dyes (including, but not limited to, Direct Yellow 96) and fiber reactive dyes (including, but not limited to, Remazol Luminous Yellow FL). Dyes that enable dyeing of the FR modacrylic fibers to a high-visibility shade include, but are not limited to, basic dyes such as Basic Yellow 40.

In one example, the FR modacrylic fibers and the synthetic cellulosic fibers of fabrics having Fabric Blends #1-4 (disclosed above) as well as an additional fabric blend (Fabric Blend #5 having approximately 50% PROTEX W™ (FR modacrylic), approximately 39% TENCEL A100™ (cellulosic), approximately 10% TWARON™ (para-aramid), and approximately 1% antistat)) were dyed in accordance with a two-step exhaust dyeing process using Basic Yellow 40 to dye the FR modacrylic fibers and Remazol Luminous Yellow FL to dye the TENCEL A100™ fibers. The results are set forth below in Table 2.

TABLE 2

| FABRIC BLEND | % Basic Yellow 40 Dye (owf) | % Remazol Yellow FL Dye (owf) | Alkali (Soda Ash) Caustic | Salt (Sodium Sulphate) | Pass ANSI 107-2004? |
|---|---|---|---|---|---|
| Fabric Blend #1 | 1.20 | 3.85 | 5.00 g/L/1.292 g/L(NaOH50%) | 80 g/L | Yes |
| Fabric Blend #1 | 1.20 | 5.00 | 5.00 g/L/1.292 g/L(NaOH50%) | 80 g/L | Yes |
| Fabric Blend #1 | 2.25 | 3.85 | 5.00 g/L/1.292 g/L(NaOH50%) | 80 g/L | Yes |
| Fabric Blend #1 | 2.25 | 5.00 | 5.00 g/L/1.292 g/L(NaOH50%) | 80 g/L | Yes |
| Fabric Blend #2 | 1.20 | 3.85 | 5.00 g/L/1.292 g/L(NaOH50%) | 80 g/L | Yes |
| Fabric Blend #2 | 1.20 | 5.00 | 5.00 g/L/1.292 g/L(NaOH50%) | 80 g/L | Yes |
| Fabric Blend #2 | 2.25 | 3.85 | 5.00 g/L/1.292 g/L(NaOH50%) | 80 g/L | Yes |
| Fabric Blend #2 | 2.25 | 5.00 | 5.00 g/L/1.292 g/L(NaOH50%) | 80 g/L | Yes |
| Fabric Blend #3 | 1.20 | 3.85 | 5.00 g/L/1.292 g/L(NaOH50%) | 80 g/L | Yes |
| Fabric Blend #3 | 1.20 | 5.00 | 5.00 g/L/1.292 g/L(NaOH50%) | 80 g/L | Yes |
| Fabric Blend #3 | 2.25 | 3.85 | 5.00 g/L/1.292 g/L(NaOH50%) | 80 g/L | Yes |
| Fabric Blend #3 | 2.25 | 5.00 | 5.00 g/L/1.292 g/L(NaOH50%) | 80 g/L | Yes |
| Fabric Blend #4 | 1.20 | 3.85 | 5.00 g/L/1.292 g/L(NaOH50%) | 80 g/L | Yes |
| Fabric Blend #4 | 1.20 | 5.00 | 5.00 g/L/1.292 g/L(NaOH50%) | 80 g/L | Yes |
| Fabric Blend #4 | 2.25 | 3.85 | 5.00 g/L/1.292 g/L(NaOH50%) | 80 g/L | Yes |
| Fabric Blend #4 | 2.25 | 5.00 | 5.00 g/L/1.292 g/L(NaOH50%) | 80 g/L | Yes |
| Fabric Blend #5 | 1.20 | 3.85 | 5.00 g/L/1.292 g/L(NaOH50%) | 80 g/L | Yes |
| Fabric Blend #5 | 1.20 | 5.00 | 5.00 g/L/1.292 g/L(NaOH50%) | 80 g/L | Yes |
| Fabric Blend #5 | 2.25 | 3.85 | 5.00 g/L/1.292 g/L(NaOH50%) | 80 g/L | Yes |
| Fabric Blend #5 | 2.25 | 5.00 | 5.00 g/L/1.292 g/L(NaOH50%) | 80 g/L | Yes |

Fabrics having the FR modacrylic/synthetic cellulosic blends (and particularly those using TENCEL™ and TENCEL A100™ fibers) may be dyed in compliance with the military's infrared reflective requirements (including, but not limited to, those promulgated under MIL-C-83429 and GL-PD-07-12 (Feb. 28, 2007)). Vat dyes have proven particularly suitable for dyeing the fabrics in compliance with such standards. Vat dyeing techniques, such as, but not limited to, those disclosed in Textile Dyeing and Coloration by J. R. Aspland (Chapters 4: Vat Dyes: General and 5: Vat Dyes and their Application), are well known in the art and thus not discussed in detail herein. The fabrics disclosed herein may also be printed with dyes or pigments. For example, such fabrics may be printed in compliance with the military's infrared reflective requirements with vat dyes using printing techniques well known in the art.

After all dyeing has been completed, the fabric then can be finished in conventional manner. This finishing process can include the application of FR treatments, anti-microbial agents, insect repellent agents, pesticides, soil release agents, wicking agents, water repellents (e.g., perfluorohydrocarbon), stiffening agents, softeners, and the like.

Fabrics having the fiber blends disclosed herein can be used to construct the entirety of, or various portions of, a variety of protective garments for protecting the wearer against electrical arc flash and flames, including, but not limited to, coveralls, jumpsuits, shirts, jackets, vests, and trousers. Retroreflective elements, such as strips of retroreflective tape, may be provided on portions of the exterior of the garments to enhance the visibility of the garment wearer.

In one embodiment, a fabric having blends of fibers disclosed herein is used to form at least a portion of an advanced combat shirt. Advance combat shirts are worn under bullet proof vests. When a bullet proof vest is positioned over the shirt, the shoulders and sleeves of the shirt typically remain exposed but the body portion of the shirt is substantially covered by the vest. Thus, the shoulders and sleeves of the shirt have traditionally been made from woven or heavy weight knit FR fabrics (such as those disclosed in U.S. Pat. No. 6,867,154, the entirety of which is herein incorporated by reference) that protect the wearer against flame and radiant energy and are typically printed (such as with a camouflage pattern) to ensure the wearer does not stand out in his or her surrounding environment.

Because the body portion of the shirt is concealed by the bullet proof vest which protects the wearer's torso, it need not be made from the same materials or afford the same level of FR protection to the wearer. The inventors have discovered that forming the body portion of the shirt from an FR fabric having a blend that includes FR modacrylic and synthetic cellulosic fibers results in a shirt with better wear properties that is more comfortable to the wearer. In one embodiment, the body portion of the shirt is formed of a 50/50 blend of FR modacrylic fibers and synthetic cellulosic fibers (suitable examples of each of which are identified in the discussion above).

The blend need not only include FR modacrylic and synthetic cellulosic fibers, however. Rather, other fibers may be added to the blend, including, but not limited to, additional inherently FR fibers (suitable examples of which are identified in the discussion above), polyester fibers, nylon fibers, or fibers that impart stretchability to the resulting fabric (e.g., spandex). In an alternative embodiment, the fiber blend includes between approximately 30-60% FR modacrylic fibers, approximately 20-60% synthetic cellulosic fibers, approximately 5-30% additional inherently FR fibers, and between 5-25% nylon fibers. In a more specific embodiment, the fiber blend includes approximately 50% modacrylic fibers (and preferably, but not necessarily, PROTEX W™ fibers), 30% lyocell fibers (and preferably, but not necessarily, TENCEL A100™ fibers), 10% para-aramid fibers (and preferably, but not necessarily, TWARON™ fibers), and 10% nylon fibers.

The fiber blend is formed into yarns that is then used to form the fabric for use in the body portion of the shirt. While any type of yarn may be formed, spun yarns are particularly suitable in this application given their high absorptive properties. It has been found that a fabric provided with apertures (i.e., a mesh fabric) is particularly well-suited in this application because the resulting mesh fabric is breathable and allows air to circulate under the vest and thus keeps the wearer cool. The mesh fabric may be formed in a variety of ways, with knitting, and particularly circular knitting, being particularly suitable.

Any portion of the shirt may be formed from the mesh material. Depending on the stretchability of the mesh, it may be desirable to incorporate stretchable panels of FR fabric into the shirt (such as in side panels of the shirt) for ease of donning and removing the garment by the wearer. The stretchable panels may be formed of any FR fabric, including, but not limited to, the fabrics contemplated herein.

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A woven or knitted flame resistant fabric for garments comprising a fiber blend, wherein:

i. the fiber blend comprises a first type of inherently flame resistant fibers and a plurality of non-flame resistant synthetic cellulosic fibers;

ii. the first type of inherently flame resistant fibers comprises modacrylic fibers;

iii. the percentage of modacrylic fibers in the fiber blend is greater than the percentage of synthetic cellulosic fibers in the fiber blend, characterized in that iv. the non-flame resistant synthetic cellulosic fibers comprise lyocell; and v. the fiber blend further comprises a second type of inherently flame resistant fibers, wherein the percentage of modacrylic fibers in the fiber blend comprises a first percentage, wherein the percentage of synthetic cellulosic fibers in the fiber blend comprises a second percentage, wherein the second type of inherently flame resistant fibers comprises meta-aramid fibers comprising a third percentage of the fiber blend, and wherein the fabric has a weight greater or equal to 3 osy and less than or equal to 6 osy.

2. The fabric of claim 1, wherein the third percentage is less than the first percentage and is less than the second percentage.

3. The fabric of claim 1, wherein the fiber blend comprises approximately 30-60% of the first type of inherently flame resistant fibers, approximately 20-60% of the non-flame resistant synthetic cellulosic fibers, and approximately 5-30% of the second type of inherently flame resistant fibers.

4. The fabric of claim 1, wherein the fiber blend further comprises a plurality of high tenacity fibers comprising at least one of nylon fibers or polyester fibers.

5. The fabric of claim 1, wherein the fiber blend comprises approximately 40-50% modacrylic fibers, approximately 30-40% non-flame resistant synthetic cellulosic fibers, and approximately 10-15% aramid fibers.

6. The fabric of claim 1, wherein the fabric has a weight greater or equal to 3 osy and less than or equal to 5 osy.

7. The fabric of claim 1, wherein the fabric comprises an arc thermal protection value when tested according to ASTM Test F1959 and wherein the ratio of the arc thermal protection value to the weight is at least 1.05.

8. The fabric of claim 7, wherein the ratio is at least 1.10.

9. The fabric of claim 1, wherein the fiber blend further comprises at least one of para-aramid fibers, polybenzimidazole fibers, polybenzoxazole fibers, melamine fibers, carbon fibers, pre-oxidized acrylic fibers, polyacrylonitrile fibers, or polyamide-imide fibers.

10. The fabric of claim 9, wherein the fiber blend further comprises para-aramid fibers.

11. The fabric of claim 1, wherein the fabric is formed of yarns and all of the yarns in the fabric comprise the fiber blend.

12. The fabric of claim 1, wherein the fabric has a before-wash char length less than or equal to 4 inches when tested according to ASTM Test D6413.

13. The fabric of claim 1, wherein the fabric has an afterflame less than 2 seconds when tested according to ASTM Test D6413.

14. The fabric of claim 1, wherein the fabric complies with at least one of ANSI 107-2004, NFPA 2112, and NFPA 70E.

15. The fabric of claim 1, wherein the third percentage comprises approximately 10-15% of the fiber blend.

16. A garment comprising the fabric as claimed in claim 1.

17. The garment of claim 16, wherein the garment is a shirt comprising a body portion, wherein at least a portion of the body portion comprises the fabric.

* * * * *